United States Patent [19]

Av-Zuk

[11] 4,218,860

[45] Aug. 26, 1980

[54] PROFILE FOR HOLDING PANELS

[76] Inventor: Moshe Av-Zuk, P.O. Box 28075, Tel-Aviv, Israel

[21] Appl. No.: 932,407

[22] Filed: Aug. 9, 1978

[30] Foreign Application Priority Data

Aug. 9, 1977 [IL] Israel ..... 52693

[51] Int. Cl.[2] ..... E04B 5/52

[52] U.S. Cl. ..... 52/484; 52/738

[58] Field of Search ..... 52/483–486, 52/582, 738

[56] References Cited

U.S. PATENT DOCUMENTS

| | | | |
|---|---|---|---|
| 3,058,171 | 10/1962 | Wright | 52/484 X |
| 3,204,383 | 9/1965 | Adams | 52/484 X |
| 3,228,163 | 1/1966 | Lindström | 52/484 X |

*Primary Examiner*—J. Karl Bell

*Attorney, Agent, or Firm*—Browdy and Neimark

[57] ABSTRACT

According to the present invention there is provided a profile for holding suspended panels forming a false ceiling, comprising a strip of material, part of the strip being composed of a two ply portion, the two plies separating by being bent from the said two ply portion, springy tongues being punched out of the individual layers of the two ply portion, at distances from one another, the tips of said tongues being directed towards the free edge of the two ply portion.

According to a preferred embodiment the profile consists of a strip of material which is bent double lengthwise, the free margins of the strip being bent apart to form an obtuse angle, the extreme marginal portions extending normal to the doubled part; springy tongues being punched out of the doubled portions, at distances from one another, the tips of such tongues being directed towards the bend of the doubled portion.

3 Claims, 2 Drawing Figures

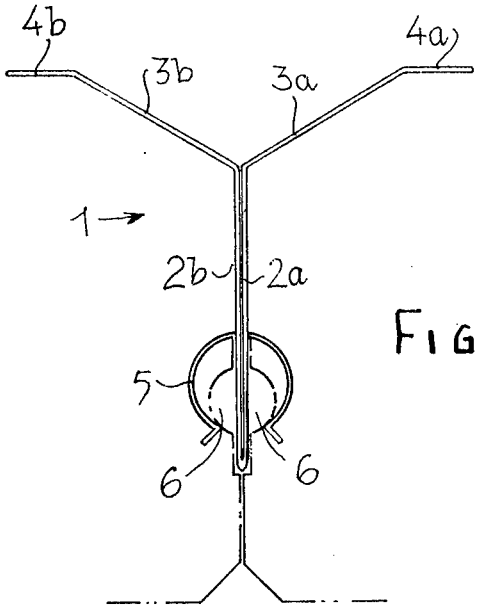
FIG. 1
FIG. 2
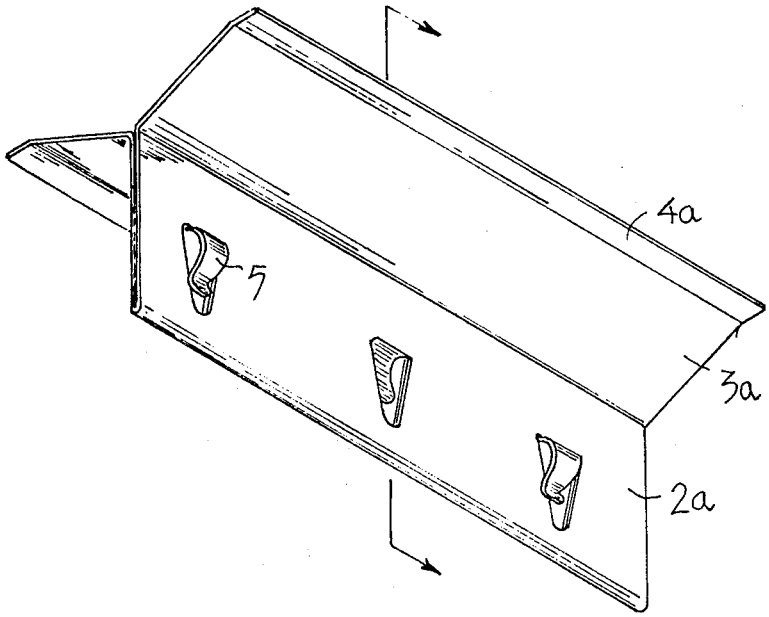

PROFILE FOR HOLDING PANELS

FIELD OF THE INVENTION

The present invention relates to an improvement in connection with false ceilings. As is well known false ceilings are composed from panels made either of sheet metal or plastics which are suspended some distance below the built ceiling so that an air space is formed between the false and the real ceiling in which space electrical wires and other conductors can be accommodated.

BACKGROUND OF INVENTION

In constructing false ceilings care must be taken that the ceilings formed on individual panels are absolutely plane, i.e. that all panels assume position in the same level. Furthermore the suspension must be secure so that no changes in the position of the individual panels could be expected.

SUMMARY OF THE INVENTION

The present invention provides a profile which can be made in lengths which are equivalent to the room in which the false ceiling is to be constructed, which are suspended by means of chains, rods or wires from the real ceiling and which are intended to hold the panels securely and fixedly. According to the invention, there is provided a profile which comprises a strip of material, part of the strip being composed of a two ply portion, the two plies separating by being bent from the said two ply portion, springy tongues being punched out of the individual layers of the two ply portion, at distances from one another, the tips of said tongues being directed towards the free edge of the two ply portion.

According to a preferred embodiment of the invention there is provided a profile consisting of a strip of material which is bent double lengthwise, the free margins of the strip being bent apart to form an obtuse angle, the extreme marginal portions extending normal to the doubled part; springy, tongues being punched out of the doubled portions, at distances from one another, the tips of such tongues being directed towares the bend of the doubled portion.

According to a further feature of the invention, tongues punched out of one layer of the doubled portion are passed through the registering aperture in the other layer.

BRIEF DESCRIPTION OF THE DRAWINGS

The invention will now be described in detail with reference to the annexed drawings in which the preferred embodiment of the invention is shown by way of example, in which:

FIG. 1 is a sectional view and

FIG. 2 perspective view of a portion of the new profile.

DESCRIPTION OF THE PREFERRED EMBODIMENT

The new profile indicated as a whole by the numeral 1 comprises a portion which consists of two layers 2*a* and 2*b* which are obtained by bending double lengthwise a strip of material which either may be sheet metal or an appropriate plastics. The marginal portion of the profile, i.e. the two layers are bent apart at 3*a* and 3*b* so as to form a shallow V, i.e. an obtuse angle. The extreme marginal portions 4*a* and 4*b* are bent out of the plane of the portion 3*a* and 3*b* to assume a position which is normal to the portion 2*a* and 2*b*. Within the range of the two layers 2*a* and 2*b* tongues 5 are punched out of the layers at distances from one another (see FIG. 2). These tongues are springy due to the inherent qualities of the material used. As shown in FIGS. 1 and 2 a tongue 5 of say portion 2*a* is bent and pushed through the aperture obtained by punching out tongue 2*b* while the tongue 5 from portion 2*b* is bent through the aperture in portion 2*a*. Thus the tongues change places in relation to the portions from which they have been punched.

In use these tongues are intended to clampingly hold the panels which are indicated by broken line in FIG. 1 and which are tray shaped and are provided with a bead 6 at their edges which bead is being engaged by the said tongues 5. The profiles 1 are suspended from the real ceiling by whatever conventional means at a distance chosen in accordance with the conditions of the case. Once these profiles are in place the tray shaped panels are connected thereto by pressing the beads 6 into the clamping space of the tongue 5 which latter snap over the beads and hold the tray shaped panels securely in place.

It will be seen that by the new profiles the tray shaped panels are securely held and are also kept at a common level, since the roots of the tongues—which obviously are in a common straight line—exactly defines the uppermost level to which the edge of the panel can be punched in upward direction. Furthermore, each panel is securely held individually, in contradistinction to previously known means where two vicinal panels had to be clamped together, so as to quasi find mutual support by one another.

I claim:

1. A profile for securely and individually holding suspended panels forming a false ceiling, the profile comprising a strip of material, part of said strip being composed of a two ply portion having a free edge, the two plies thereof being bent apart from one another to form a pair of separated single ply portions connected to said two ply portion, springy tongues being punched out of individual layers of said two ply portion, at distances from one another, tips of said tongues being directed towards said free edge of said two ply portion.

2. A profile as claimed in claim 1, wherein the profile consists of a strip of material which is bent double lengthwise to form said two ply portion, its free edge being at the bend, free margins of said strip being bent apart to form said pair of single ply portions, each said single ply portion forming an obtuse angle with said double ply portion, extreme marginal portions of said pair of single ply portions being bent to extend normal to said double ply portion; said springy tongues being punched out of said two ply portion at distances from one another, tips of said tongues being directed towards the bend of said two ply portion which constitutes its free edge.

3. A profile as claimed in claim 2, wherein said tongues punched out of respective layers of said two ply portion are passed through a respective registering aperture in the other one of said layers of said two ply portion.

* * * * *